US009518399B2

(12) United States Patent
Wares

(10) Patent No.: US 9,518,399 B2
(45) Date of Patent: Dec. 13, 2016

(54) FOLDABLE CHILDREN'S WADING POOL AND METHOD OF USE

(71) Applicant: Larry Wares, San Clemente, CA (US)

(72) Inventor: Larry Wares, San Clemente, CA (US)

( * ) Notice: Subject to any disclaimer, the term of this patent is extended or adjusted under 35 U.S.C. 154(b) by 157 days.

(21) Appl. No.: 14/564,481

(22) Filed: Dec. 9, 2014

(65) Prior Publication Data

US 2016/0160517 A1 Jun. 9, 2016

(51) Int. Cl.
*E04H 4/00* (2006.01)
*E02D 27/38* (2006.01)

(52) U.S. Cl.
CPC ..... *E04H 4/0018* (2013.01); *E02D 27/38* (2013.01); *E04H 2004/0068* (2013.01)

(58) Field of Classification Search
CPC ..... E04H 4/0025
USPC ..... 4/488–513
See application file for complete search history.

(56) References Cited

U.S. PATENT DOCUMENTS 4,597,113 A * 7/1986 Eymard ..... E04H 4/0025 4/488
4,860,914 A 8/1989 Derni
4,935,970 A 6/1990 Aristone
5,881,402 A 3/1999 Devino
6,408,454 B1 * 6/2002 Hyde ..... E04H 4/0018 4/506
6,684,429 B1 2/2004 Deering
6,886,189 B1 5/2005 Wu
7,308,989 B2 12/2007 Zheng
2003/0019024 A1 1/2003 Tompkins
2004/0140306 A1 7/2004 Arias
2007/0248414 A1 * 10/2007 Fratianni ..... E04H 4/00 405/53
2010/0294759 A1 * 11/2010 Yu ..... E04H 15/006 220/9.3
2011/0131719 A1 * 6/2011 Rudenberg ..... E04H 4/0056 4/495
2012/0023655 A1 * 2/2012 Junquet ..... E04H 4/0018 4/513
2014/0020169 A1 1/2014 Capps
2014/0137320 A1 * 5/2014 Taylor ..... E04H 4/0018 4/506

FOREIGN PATENT DOCUMENTS

EP 312731 A2 11/2002

* cited by examiner

*Primary Examiner* — Lori Baker
(74) *Attorney, Agent, or Firm* — Lapple Ubell IP Law, LLP; Matthew C. Lapple

(57) ABSTRACT

A foldable, portable fabric children's wading pool for installation in the ground and which has improved stability characteristics is provided. The pool includes a waterproof fabric base, a middle stabilizer section with a foam stiffening strip, and a sand anchor section with sleeves for holding a weighting material such as sand. The pool is set up by digging a hole in the ground and forming berms along the edges of the hole. Then, the pool is unfolded and positioned such that the waterproof fabric base is in the hole, the middle stabilizer section is on the top of the sand berm, and the sand anchor section extends downwardly and outwardly from the edge of the sand berm. Then, a weighting material is loaded into the sand anchor section and the pool is filled with water, preferably using the waterproof bag that also serves as a storage and transport bag for the pool when folded.

20 Claims, 5 Drawing Sheets

FOLDABLE CHILDREN'S WADING POOL AND METHOD OF USE

CROSS-REFERENCE TO RELATED APPLICATIONS

None.

BACKGROUND OF THE INVENTION

Going to the beach, either at the ocean or at a lake, is a common and beloved pastime for families. However, trips to the beach often present challenges to families with young children, particularly with respect to the safety and comfort of the children. Specifically, young children who have not yet learned to swim, or who are weak swimmers, should generally not be allowed to play in waves or rough surf. Further, for much of the year, although air temperatures may be pleasant, water temperatures remain too cold for young children. This is particularly true along the Pacific Coast of California. Nevertheless, few children want to go to the beach and not play in the water. As such, it has become popular to bring a portable swimming pool to the beach, filing the pool with ocean or fresh water, and permitting the child or children to bathe or swim therein. These portable pools are well known in the prior art and are typically inflatable or molded from plastic.

Such prior art portable pools are cumbersome, take up significant room in the family's vehicle and tend to be unstable in the sand. Therefore, it would be advantageous to provide a portable wading pool for use at the beach which is easily transportable and stable when in place at the beach. Prior art portable pools also generally fail to address the fact that, when filled with cold ocean water, they take considerable time to warm up to a temperature which would be comfortable for small children to bathe in.

Some prior art approaches to solving the problems of transportability and stability have focused on positioning a rubber or fabric pool in a hole dug into the sand. However, each of these prior art approaches suffer from various instability and inconvenience problems. U.S. Pat. No. 5,881,402 entitled "Portable In-Ground Pool" issued to Devino on Mar. 16, 1999, discusses a portable pool for beach use which employs an inflatable circumferential ledge which is secured into the sand utilizing stakes. Several disadvantages of this prior art pool are the fact that it must be inconveniently staked down and inflated to try to achieve stability. However, it is likely still is unstable and prone to deformation of the pool and collapse of the sand sidewalls, or having the stakes pulled out of the sand when the pool is filed and/or children enter and exit it, due to the weight of water and children on the sides and bottom of the pool, all of which could lead to failure of the pool fabric, leakage of water, causing falls of children entering or exiting the pool, and causing undue amounts of sand to fall into the pool.

Published Patent Application No. US 2007/0248414 A1, is entitled "Method and Apparatus for Making a Pool," was filed by Ralph Fratianni on Apr. 20, 2007 and was published on Oct. 25, 2007. This published application discusses an apparatus for forming a pool including a panel of waterproof material supportable by a surface of a concaved area of sand and at least one sleeve or pouch coupled to or formed in an outer edge of the material, the at least one sleeve or pouch capable of holding a weighting substance and preventing an entire outer edge of the material from being relocated by the wind. Disadvantages of this prior art pool include instability and a tendency to have deformation of the pool and collapse of the sand sidewalls, when the pool is filed and/or children enter and exit it, due to the weight of water and children on the sides and bottom of the pool, all of which could lead to failure of the pool fabric, leakage of water, causing falls of children entering or exiting the pool, and causing undue amounts of sand to fall into the pool. Moreover, the described sleeve or pouch would appear to be difficult to load and unload with weighting material that is readily available at the beach, namely sand.

Published Patent Application No. US 2012/0023655 A1, is entitled "Portable Swimming Pool for Beach Use," was filed by Jeffrey Junquet on Jul. 26, 2011 and was published on Feb. 2, 2012. This published patent application discusses a portable swimming pool for use at the beach formed from vinyl or other flexible waterproof material comprising a circular base and a side wall that extends upward from the base and tapers outward as it extends up. To use it, a user digs a hole and unfolds the pool into the hole. The Junquet portable swimming pool discussed also includes a sand apron extending outwardly from the edge of the side wall, which can be laid out on the surface of the sand next to the hole, and then covered with sand, which allegedly provides stability. Disadvantages of this prior art pool include instability in the interface between the pool and the sand, a tendency to have deformation of the pool and collapse of the sand sidewalls, when the pool is filed and/or children enter and exit it, due to the weight of water and children on the sides and bottom of the pool, all of which could lead to failure of the pool fabric, leakage of water, causing falls of children entering or exiting the pool, and, due to the sand apron laying flat on the surface of the sand—and then be covered with a layer of sand—having undue amounts of sand to fall into the pool as children enter and exit it.

Thus, there is a need to be able to have a portable wading pool that that is stable, with respect to both wind and shifting sand, is able to easily allow children to climb into and out of the pool, while withstanding the rigors of children climbing into and out of the pool when filled with water and not filling with spilled sand. Additionally, a portable wading pool that warms water quickly for use with cold ocean water is needed and preferable.

SUMMARY OF THE INVENTION

The present invention addresses and alleviates these problems with prior art. While various embodiments of the foldable children's wading pool of the present invention exist, as will be understood by one of ordinary skill in the art, each generally includes a foldable waterproof fabric base, a middle stabilizer section attached to that base and incorporating a stiffening foam strip, and a sand anchor section with at least one sleeve to allow insertion of a weighting material such as sand.

The approach taken by the present invention foldable pool is to provide a portable pool which is situated into a hole dug into the beach sand, using sand berms along the edges of the hole; whereby said berms are engaged by the pool sidewall, the middle stabilizing section and the sand anchors, in order to provide lateral support and stability to the pool.

DETAILED DESCRIPTION OF THE EMBODIMENTS

Figure 1:
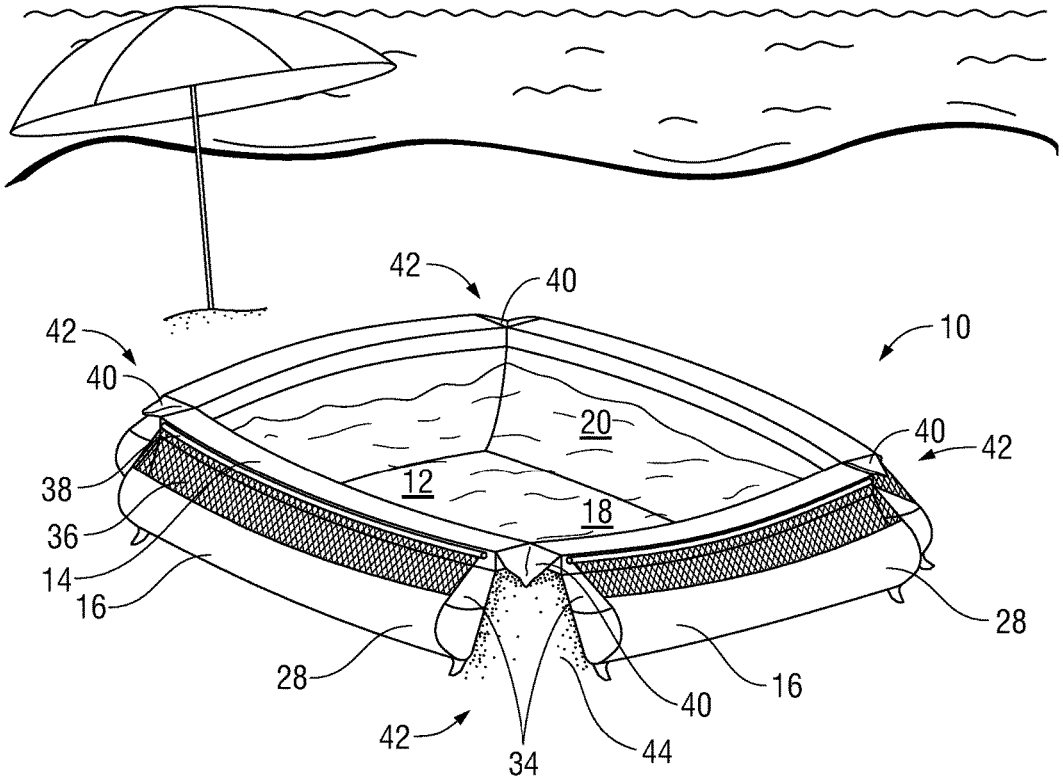
FIG. 1 is a perspective view of a preferred embodiment of a foldable children's wading pool of the present invention that is in use at a beach.

A first embodiment of the portable children's wading pool 10 is illustrated in FIG. 1. The pool 10 includes a waterproof fabric base 12, a middle stabilizer section 14, and a sand anchor section 16. The waterproof fabric base 12 has a bottom section 18 and at least one side section 20. In the embodiment shown, the waterproof fabric base 12 has four side sections 20, each of which is bonded, sewn or otherwise attached to the bottom section in a manner that will ensure that the entire waterproof fabric base 12 will remain generally waterproof. The bottom section 18 of the waterproof fabric base 12 is generally oval shaped, and each of the side sections 20 are generally trapezoidal, such that when the pool 12 is unfolded and in place, the side sections 20 generally taper downwardly and inwardly toward the bottom section 18. The waterproof fabric base 12 can be comprised of any suitable waterproof material, such as but not limited to polyester canvas with polyurethane coating, plasticized polyvinyl chloride (PVC) and, or low-density polyethylene (LDPE). Preferably, it is comprised of a waterproof fabric material that is durable when repeatedly exposed to water, salt water, sand and sun. Further preferably, the waterproof fabric base 12 is a dark color, for example black or dark grey, so that when the sun strikes it, the material will warm quickly and help heat up any water in the pool when it is filled.

Figure 6:
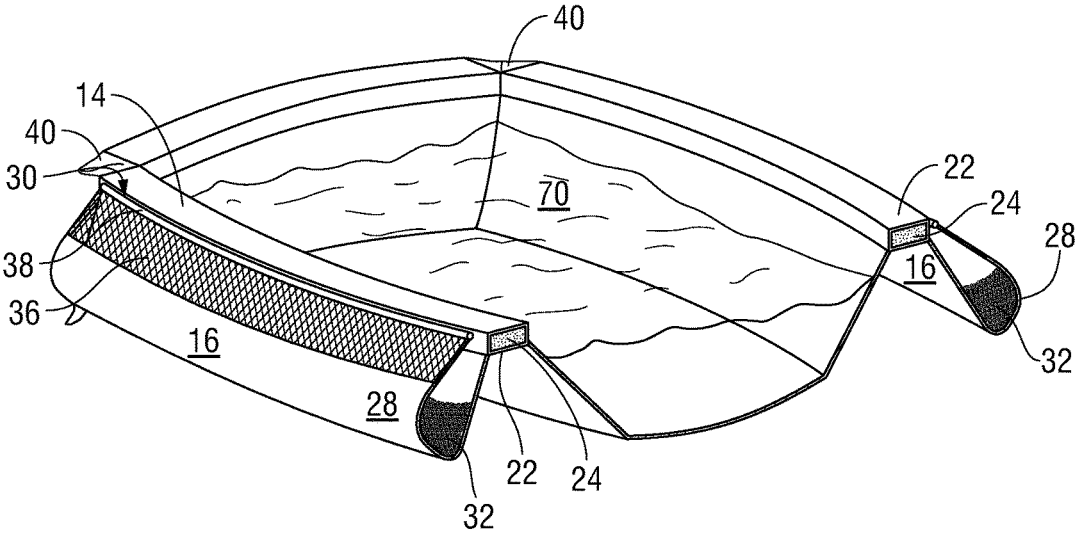
FIG. 6 is a cutaway perspective view of a preferred embodiment of a foldable children's wading pool of the present invention that is in use.
Figure 7:
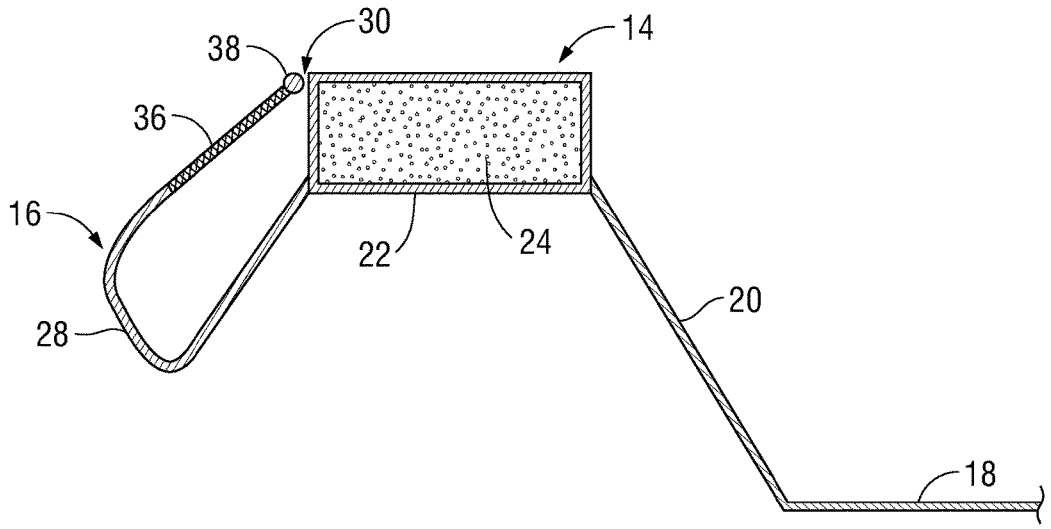
FIG. 7 is a not-to-scale side cutaway drawing of one embodiment of a foldable children's wading pool illustrating the middle foam stabilizer section and the sand anchor pocket.
Figure 8:
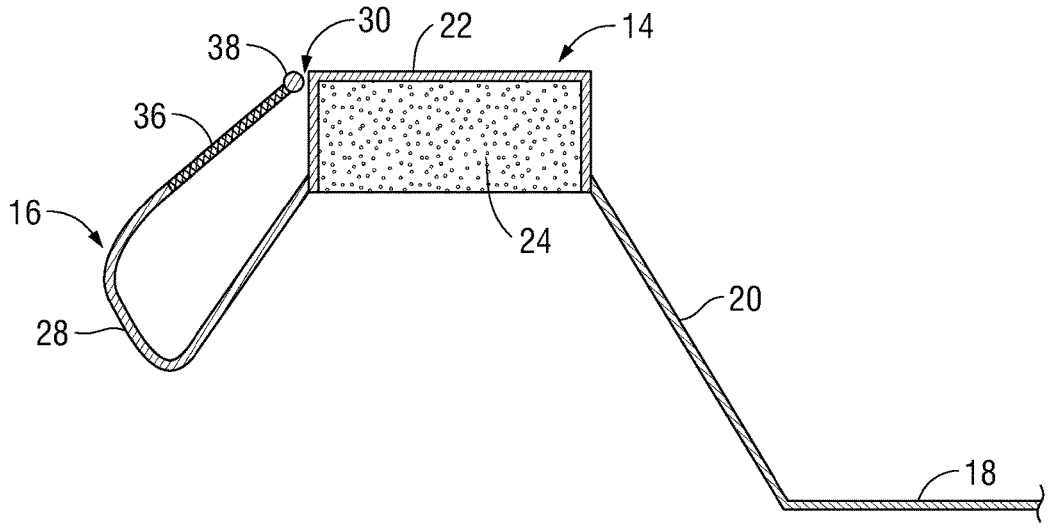
FIG. 8 is a not-to-scale side cutaway drawing of another embodiment of a foldable children's wading pool illustrating the middle foam stabilizer section and the sand anchor pocket.

The portable children's pool 10 is stabilized against being blown by the wind and against shifting sand caused by the entry and exist of children into the pool by the integrated action of the middle stabilizer section 14 and the sand anchor section 16. As shown in greater detail in FIGS. 6-8, the middle stabilizer section 16 is comprised of fabric 22 and a foam stiffening strip 24. The fabric 22 may be the same kind waterproof fabric used for the waterproof fabric base 12, or it can be any fabric that is suitably durable when exposed to water, salt water, sand and sun. The foam stiffening strip 24 is attached to the fabric 22 by stitching, gluing or any other suitable method known to one of ordinary skill in the art. As shown in FIGS. 6 & 7, the fabric 22 may entirely enclose the foam stiffening strip 24, or alternatively, as shown in FIG. 8, the fabric 22 may be attached to the top of the foam strip 24. Alternatively the foam stiffening strip 24 may be attached to the top of the fabric 22, although that embodiment is not explicitly shown.

The foam stiffening strip 24 may be comprised of any foam that will provide increased rigidity to the middle stabilizer section without preventing the middle stabilizer section 14 from being folded for storage. Preferably, the foam stiffening strip 24 is pre-creased at specific intervals to aide a user in the folding operation. Also preferably, the foam stiffening strip is comprised of a closed-cell foam, in order to prevent absorption of water resulting in increased weight and waterlogging during and after use. For example, the foam stiffening strip 24 may be made from foams including polyethylene, cross-linked polyethylene, expanded polystyrene ("EPS"), neoprene rubber and "gym rubber", i.e., polyvinyl chloride nitrile butadiene rubber (PVC/NBR).

The middle stabilizer section 14 is attached to, or an integral extension of, the waterproof fabric base 12. Preferably, the fabric 22 of the middle stabilizer section 14 is attached to or an integral extension of the side sections 18 of the waterproof fabric base 12.

The sand anchor section 16 is attached to, or an integral extension of, the middle stabilizer section 14. Preferably, the fabric of the sand anchor section 16 is attached to or an integral extension of the middle stabilizer section 14. As shown in FIGS. 1, and 6-8, the sand anchor section is preferably a sleeve 28 of fabric that extends for the entire length of the middle stabilizer section 14. The sand anchor sleeve 28 is open at its top 30, although in alternate embodiments, it can be closed. The open top 30 of the sleeve 28 is preferable in order to enable easy loading and unloading of a weighting material, such as sand 32, into the sand anchor section 16 when the pool 10 is being set up. Preferably, the sleeve 28 is also open, or primarily open, at each end 34 of each sleeve 28. The open ends 34 of the sleeve 28 enable the easy unloading of the weighting material from the sleeve 28 of the sand anchor section 16 when the pool 10 is being put away for travel and storage. The ends of the sleeve may also be partially closed, in order to help retain the weighting material. Further, in a preferred embodiment, the sand anchor section 16 has a mesh window 36 at the top of the sleeve 28. This mesh window 36 is made of any suitable mesh that will be durable when exposed to water, salt water, sand and sun. The mesh window 36 also increases the ease with which weighting material can be loaded and unloaded into the sand anchor section 16, as well as provides an easy way to see how much weighting material has been loaded into the sand anchor section sleeve 28. Additionally, the mesh window 36 can have an elastic cord 38 integrated into or attached to the top edge of the mesh. This elastic cord 38 is preferably attached to the fabric of either the sand anchor 16 or the middle stabilizer section 14 at at least two points, namely the ends 34 of the sand anchor section 16. The elastic cord 38 may also be attached to the fabric at convenient intervals along either the sand anchor section 16 or the middle stabilizing section 14. The elastic cord 38 assists in the ease of loading the sand anchor section 16 with weighting material, because it can be stretched open, but also assists in the retention of weighting material, because it pulls the mesh top window 36 tight against the fabric of the sand anchor section 16 or middle stabilizer section 14, when weighting material such as sand 32 is loaded into the sand anchor section 16 as shown in FIG. 6.

In the embodiment shown in FIG. 1, the middle stabilizer section 14 and attached sand anchor section 16 are divided into four segments. Each segment is attached to the waterproof fabric base 12 at the outside edge of the adjacent waterproof fabric base side section 20. In a preferred embodiment, adjacent segments of the divided middle stabilizer section 14 are attached to each other by a gusset 40 of fabric at each of the corners 42 of the pool 10. Each gusset 40 serves to strengthen the respective corner 42 of the pool 10 while at the same time allowing the foam stiffening strip 24 to be divided, thereby allowing easier folding of the pool 10 when it is to be transported and stored. The gusset 40 also allows the sand anchor section 16 to be separated into segments and not present at the corners 42 of the pool 10, thereby making it easier to approach, enter, and exit the pool at the corner 42 without stepping on the sand anchor section 16. The gusset 40 may be a simple extension of the fabric 22 that comprises the middle stabilizer section 14. It may also be a separate piece of strong fabric that is sewn or otherwise attached to each of the adjacent middle stabilizer section 14 segments.

Figure 9:
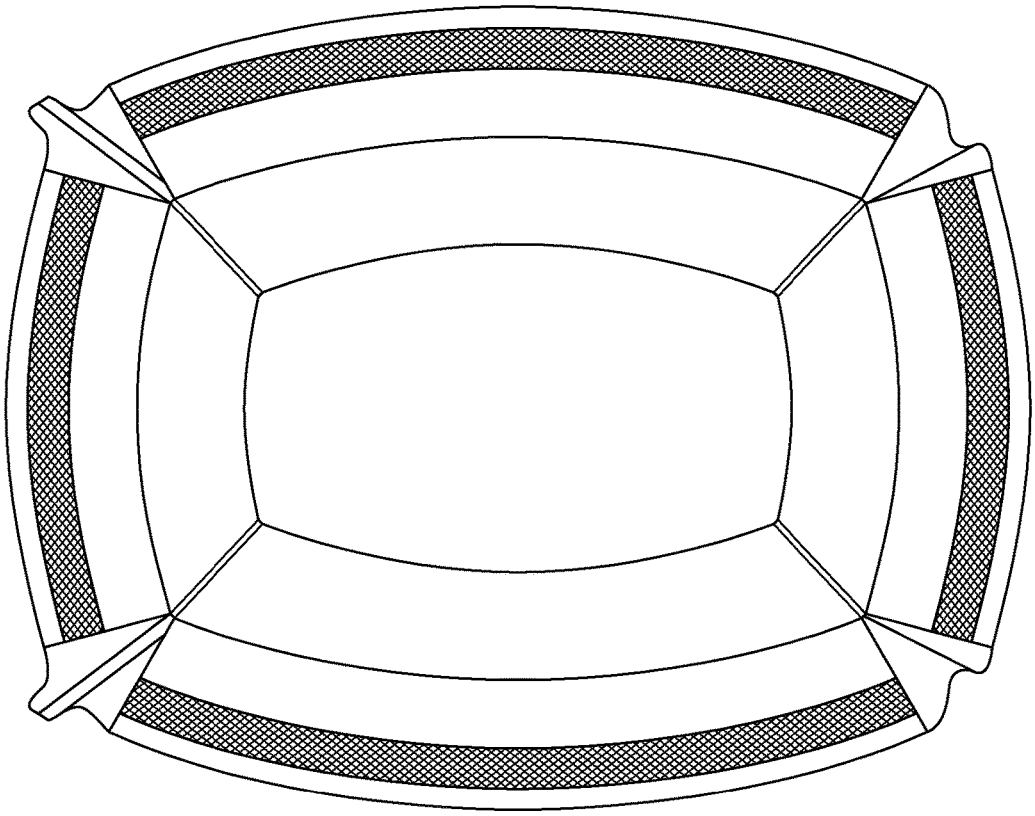
FIG. 9 is a top view of the embodiment of the foldable children's wading pool of FIG. 1.

While it will be appreciated by one of ordinary skill in the art that the pool can be of any shape, preferably, the pool 10 is configured as a generally-oval shaped pool. As used herein, the term "generally oval-shaped" is meant to refer to the non-polygon shape of the pool shown in FIG. 1 and as seen from above in FIG. 9. Namely, when viewed from above, as shown in FIG. 9, it is reminiscent of a square or rectangle, but each of the sides has been bowed or curved outwardly. This generally oval shape is made by adjusting the size and shape of the bottom section 18 of the waterproof fabric section 12, the generally trapezoidal side sections 18 of the waterproof fabric section 12, and forming each of the four segments of the middle stabilizer section 14, as a curve. In general, when the pool 10 is configured in a generally oval-shape as defined above, such a configuration improves both sand hole sidewall stability as well as the ease with which small children can enter and exit the pool without impacting its stability. When a hole is dug in the sand in a generally oval shape, rather than using straight line edges, the side walls of the sand hole, as well as the edges of the hole are generally more stable and durable. Further when the pool 10 is configured in a generally oval shape as shown, small children often find it easier to enter and exit the pool at the corners 42 of the pool 10, because they do not have to step over or on the sand anchor section 16. Further, by stepping on the corners 42 of the pool 10, the gussets 40, or the sand berm 44 at the corner of the hole, any child that is entering or exiting the pool will not crush down the sand berm 44 by stepping on the middle stabilizing section 16. Additionally, if the child steps on the corner gusset 40 of the pool 10, the weight of the child will be distributed across the fabric—and anchoring weight—of two adjoining sand anchors 16 , rather than on a single sand anchor, thereby reducing the force that would otherwise pull the middle stabilizing section 14 and the sand anchors 16 toward the center of the pool 10. Finally, this method of ingress and egress, which is in part facilitated by the shape of the pool and the use of the fabric gussets, serves to minimize the amount of sand that is accidently kicked or poured into the pool.

While not intended to be limiting in any way, in one embodiment of the present invention, the pool is approximately three feet, 6 inches long and 2 feet, 6 inches wide. The middle stabilizer section is approximately 4 inches wide and about one-half to one inch thick. The sand anchor section extends downwardly about 6-8 inches. Further, in this embodiment, the pool can be filled with approximately 18 to 24 inches of water, as measured from the bottom of the bottom section of the waterproof fabric base.

Figure 2:
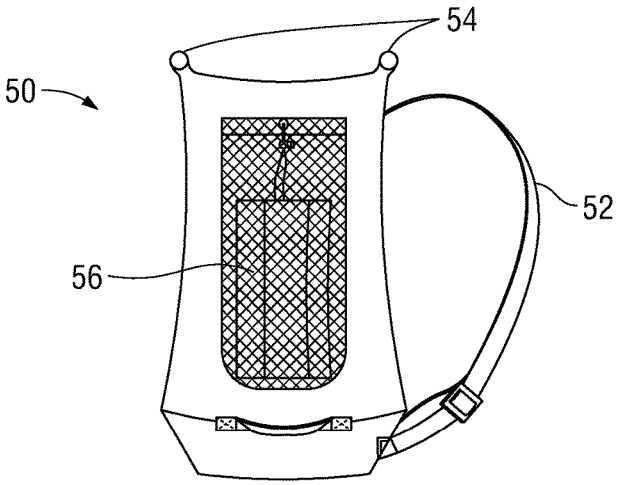
FIG. 2 is a side view of a waterproof bag into which the foldable children's wading pool of FIG. 1 can be folded for transport and storage.
Figure 3:
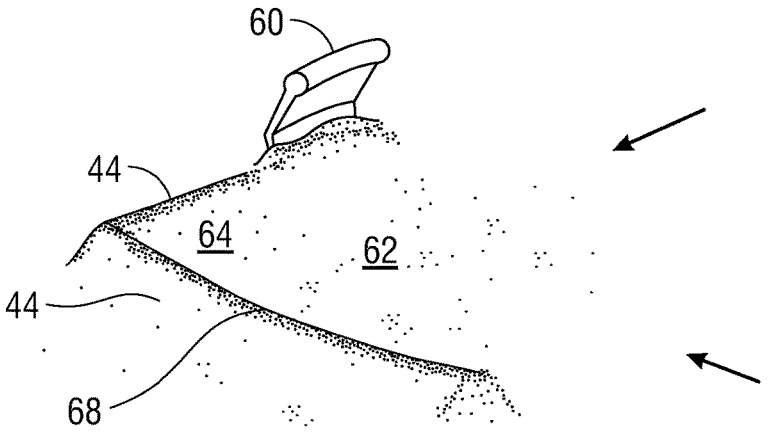
FIG. 3 is a perspective view of a step in the preferred method of deploying the foldable children's wading pool, namely using a digging tool to form a berm in the general shape of the pool edges.
Figure 4:
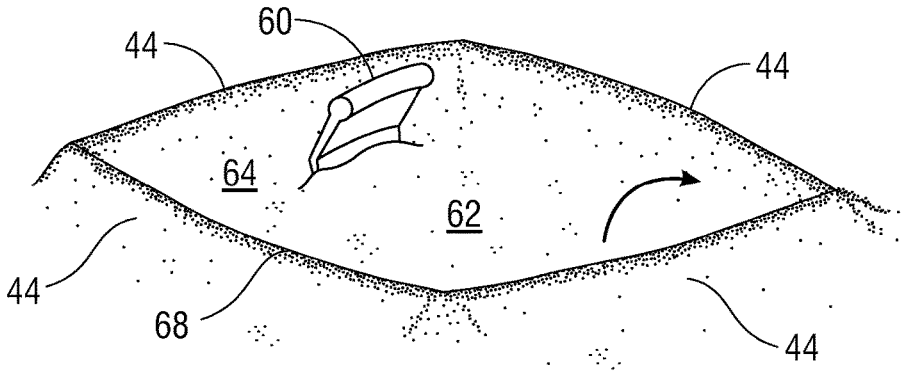
FIG. 4 is a perspective view of another step in the preferred method of deploying the foldable children's wading pool, namely using a digging tool to form a hole with berms along the edges of the hole in the general shape of the pool edges.
Figure 5:
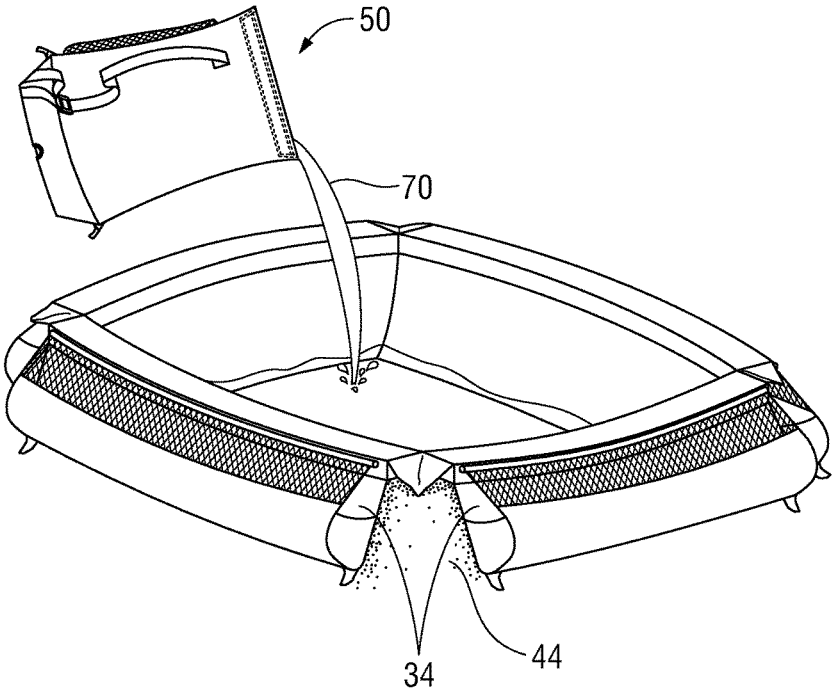
FIG. 5 is a perspective view of another step in the preferred method of deploying the foldable children's wading pool, namely using the waterproof bag to pour water into the unfolded and in-place pool.

FIG. 2 illustrates a bag 50 for use with the pool 10. The bag 50 preferably has an assortment of straps 52 and handles 54 for carrying the bag, as well as pouches 56 for carrying beach accessories. The bag is preferably large enough for the entire pool 10 to be folded and stored within the bag 50. Further, preferably, the bag 50 is made of a waterproof material so that it can be used as bucket for carrying water and filling the pool, as described further below.

In FIGS. 1 & 6, the portable children' pool 10 is shown in use at the beach. Specifically, as discussed further below, the pool 10 is unfolded, in-place in a hole with side berms in the sand, filled with water, and with the sand anchor pockets and in use at the beach. The pool 10 is set up and put in place via a series of steps illustrated in FIGS. 3-6. First, a digging tool 60, or even a user's hands, are used to outline a hole 62 in the sand that is roughly the same size as the pool 10. The user then digs the hole 62, which should taper downward and inwardly from the edges of the hole. The user also should form sand berms 44 along the edges of the hole. These sand berms 44 should be taller than the surface of the surrounding ground and generally an extension of the side walls 64 of the hole 62. The user then unfolds the pool 10 and inserts it into the hole 62. The pool 10 should be oriented so that the waterproof fabric base 12 is in the base of the hole 62. The pool 10 should be further oriented so that the middle stabilizer section 14 of the pool 10 is placed at the top 68 of each of the sand berms 44. Then, the sand anchors 16 should extend outwardly and down the outside sides of the sand berms 44. This configuration will enable the filled sand anchors 16 and the water 70 in the filled pool 10 to weigh down and press against opposing sides of the sand berm, pulling the middle stabilizing section 14 down against the top 68 of the sand berm 44. This configuration will result in a push/pull effect that stabilizes the sand at the edge of the pool, minimizes the amount of deformation to the sand wall sides of the hole that might otherwise occur when children step on the edges or sides of the pool, prevents or minimizes the fabric of the pool from being pulled downward in a way that water will spill out of the edge of the pool, and in the event of localized deformation of the sand side wall or berm, prevents instability or failure of the entire sand side wall or sand berm.

The user then uses sand 32 or other weighting material, such as pebbles or dirt, to fill the sand anchors. This is accomplished by either using sand excavated from the hole, or from other available materials. The user can insert the weighting material by pulling back the open top 30 of each sleeve 28 of the sand anchor section 16 and pouring the material in, then evenly distributing it across the length of the sleeve 28. Then, the user fills the pool 10 with water 70 or other liquid. Preferably, the user can use the waterproof fabric bag 50 as a bucket to scoop water 70 from the ocean or lake, and then pour it into the pool 10. On completion of the setup, the pool is configured as shown in FIG. 6.

When fully set up, children can play in the pool. Preferably, due to the generally oval shape of the pool, as well as the use of the segmented middle stabilizer section 14, segmented sand anchor section 16 and gussets 40, children will naturally climb into and out of the pool at the corners 42 of the pool 10, thereby minimizing stepping on, tripping on and compressing the sand anchor section 16, the middle stabilizer section 14, the sand berms 44 and sand side walls 64 of the hole 62.

When the user is ready to take the pool down, this process can be reversed. Preferably, the weighting material can be easily swept out of the sand anchor section 16 at the open ends 34 of each sleeve 28. Then, any water 70 which has not been dipped out with the bag 50 can be simply dumped out into the hole when the pool 10 is lifted. Finally, the pool 10 is folded, with folds being made at the pre-creased locations in the middle stabilizer section 14, and then stored in the waterproof fabric bag 50.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

I claim:

1. A wading pool comprising:

a waterproof fabric base with a bottom section and at least one side section;

a middle stabilizer section attached to the outside edge of the waterproof fabric base, said middle stabilizer section comprising fabric and a foam stiffening strip to stiffen the fabric of the middle stabilizer section;

a sand anchor section extending outwardly from the outward edge of the middle stabilizer section;

said sand anchor section comprising a sleeve; and said sleeve having a fabric pocket section with an open top that will allow a user to open the top of the sleeve and insert or remove weighting material.

2. The wading pool of claim 1 wherein the foam is comprised of a closed-cell foam.

3. The wading pool of claim 2 wherein the foam is selected from the following:

polyethylene, cross-linked polyethylene, expanded polystyrene, neoprene rubber and polyvinyl chloride nitrile butadiene rubber.

4. The wading pool of claim 1 wherein the foam stiffening strip is attached to the underside of the fabric of the middle stabilizer section.

5. The wading pool of claim 1 wherein the stiffening strip is fully enclosed by the fabric of the middle stabilizer section.

6. The wading pool of claim 1 wherein the stiffening strip is pre-creased at intervals in order to enable it to be folded for storage.

7. The wading pool of claim 1 wherein the sleeve further comprises a mesh top window.

8. The wading pool of claim 7 wherein the mesh top window further comprises an elastic cord incorporated along the top edge of the mesh top window; and the elastic cord is attached to the sand anchor fabric at a plurality of points.

9. The wading pool of claim 1 wherein the sleeve extends for the majority of the length of perimeter of the sand anchor section and further wherein the open top of the sleeve extends for the majority of the length of the sleeve.

10. The wading pool of claim 1 wherein the middle stabilizer section and sand anchor section are divided into four separate segments and such that each of the four separate segments of the middle stabilizer section are connected to the adjoining segment by a fabric gusset that does not have a foam stiffening strip and further such that the sand anchor sleeve does not extend below the bottom edge of the fabric gusset.

11. The wading pool of claim 10 wherein the pool is generally oval-shaped when viewed from above.

12. The wading pool of claim 11 wherein each of the sand anchor sleeves is open at each end of each sleeve below the fabric gusset.

13. The wading pool of claim 11 wherein each of the sand anchor sleeves is partially closed at each end of the sleeve below the fabric gusset.

14. The wading pool of claim 1 wherein the waterproof fabric base is dark in color, such that the dark color will cause warming by the sun of water placed in the pool.

15. The wading pool of claim 14 wherein the waterproof fabric base is black in color.

16. The wading pool of claim 1 further comprising a separate fabric bag, into which a user can fold and store the entire wading pool.

17. The wading pool of claim 16 wherein the separate fabric bag is waterproof.

18. A method for constructing an in-ground wading pool comprising:

(a) providing an in-ground wading pool comprising:

(i) a waterproof fabric base with a bottom section and at least one side section;

(ii) a middle stabilizer section attached to the outward edge of the waterproof fabric base, said middle stabilizer section comprising fabric and a stiffening strip to stiffen the fabric of the middle stabilizer section;

(iii) a sand anchor section extending outwardly from the middle stabilizer section, comprising a sleeve; and (iv) said sleeve having a fabric pocket section and a mesh top window that is secured to the top of the sand anchor section by an elastic cord that will allow a user to stretch open the top of the sleeve and insert or remove weighting material (b) digging into the ground to excavate a hole, wherein the sides of said hole taper downwardly and inwardly;

(c) forming a berm out of the same material as the ground that is taller than the surrounding ground surface and located along the edges of the hole;

(d) placing said in-ground wading pool in the hole, such that the waterproof fabric base is in contact with the bottom and sides of the hole, and the inside sides of the berm, thereby providing lateral support for the side section of the waterproof fabric base, and further such that the middle stabilizer section is in contact with the top of the berm, and further such that the sand anchor pocket is in contact with the outside sides of the berm;

(e) placing at least some of the excavated ground into the sand anchor sleeve; and (f) filling the waterproof fabric base of said in-ground wading pool with water.

19. The method of claim 18 wherein the pool is generally oval-shaped when viewed from above.

20. The method of claim 18 wherein the in-ground wading pool further comprises a separate waterproof bag and the filling step further comprises using the waterproof bag to carry and pour water into the waterproof fabric base of said in-ground wading pool.

* * * * *